US006448200B1

(12) United States Patent
Suzuki

(10) Patent No.: US 6,448,200 B1
(45) **Date of Patent: *Sep. 10, 2002**

(54) IMAGE-FORMING MEDIUM COATED WITH MICROCAPSULE LAYER ASSOCIATED WITH IMAGE-FORMATION LAYER

(75) Inventor: Minoru Suzuki, Tochigi (JP)

(73) Assignee: Asahi Kogaku Kogyo Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/510,681

(22) Filed: Feb. 22, 2000

(30) Foreign Application Priority Data

Feb. 23, 1999 (JP) ..... 11-045046

(51) Int. Cl.[7] ..... B41M 5/165
(52) U.S. Cl. ..... 503/215; 428/321.5; 503/204
(58) Field of Search ..... 503/200, 204, 503/226, 215; 428/321.5, 913, 914

(56) References Cited

U.S. PATENT DOCUMENTS

| | | | | |
|---|---|---|---|---|
| 4,399,209 A | | 8/1983 | Sanders et al. | 430/138 |
| 4,440,846 A | | 4/1984 | Sanders et al. | 430/138 |
| 4,644,376 A | | 2/1987 | Usami et al. | 503/215 |
| 5,104,767 A | | 4/1992 | Nakamura | 430/138 |
| 5,825,985 A | | 10/1998 | Asai et al. | 395/108 |
| 6,139,914 A | * | 10/2000 | Suzuki et al. | 427/213.3 |

FOREIGN PATENT DOCUMENTS

| | | | |
|---|---|---|---|
| GB | 2193687 | | 2/1988 |
| JP | 61137787 | | 6/1986 |
| JP | 87-054582/08 | * | 1/1987 |
| JP | 63-19294 | | 1/1988 |
| JP | 1093392 | * | 4/1989 |
| JP | 4-4960 | | 1/1992 |

OTHER PUBLICATIONS

English Language Abstract of JP 61–137787.

* cited by examiner

*Primary Examiner*—Bruce H. Hess
(74) *Attorney, Agent, or Firm*—Greenblum & Bernstein, P.L.C.

(57) ABSTRACT

In an image-forming medium, an image-formation layer, formed of white powder, such as calcium carbonate powder, titanium dioxide powder, silica powder, white clay powder or the like, is coated over a transparent synthetic resin film sheet. A microcapsule layer is coated over the image-formation layer, and contains at least one type of microcapsule filled with an ink. The one type of microcapsule exhibits a temperature/pressure characteristic such that each microcapsule is squashed under a predetermined pressure at a predetermined temperature, whereby the ink is discharged from the squashed microcapsule. The image-formation layer is constituted such that the discharged ink is developed in the image-formation layer.

28 Claims, 9 Drawing Sheets

IMAGE-FORMING MEDIUM COATED WITH MICROCAPSULE LAYER ASSOCIATED WITH IMAGE-FORMATION LAYER

BACKGROUND OF THE INVENTION

1. Field of the Invention

The present invention relates to an image-forming medium, coated with a layer of microcapsules filled with dye, on which an image is formed by selectively squashing and breaking the microcapsules in the layer of microcapsules.

2. Description of the Related Art

Conventionally, an image-forming medium, coated with a layer of microcapsules filled with different color dyes or inks, is known. The respective different color dyes or inks are transparent at a normal ambient temperature, but each ink develops a monochromatic color at a specific temperature. Thus, the respective different colors are selectively developed on the microcapsule layer by selectively applying specific temperatures to the microcapsule layer. In this case, it is necessary to fix a developed color by irradiation, using a light of a specific wavelength. Accordingly, this color-image-forming system is costly, because an additional irradiation apparatus for the fixing of a developed color is needed, and electric power consumption is increased due to the additional irradiation apparatus. Also, since a heating process for the color development and an irradiation process for the fixing of a developed color must be carried out with respect to each color, this hinders a quick formation of a color image on the color-image-forming medium.

Further, conventionally, a surface of the microcapsule layer is frequently covered with a transparent film sheet such that the microcapsules included therein are protected from being scratched. Also, because of the existence of the transparent film sheet, it is possible to vividly and sharply observe a color image formed on the microcapsule layer. Note, as well known, for example, a color image drawn on a sheet of paper can be more vividly and sharply observed through the intermediary of a transparent layer closely covering the drawn color image, in comparison with a case where the drawn color image is directly observed. Nevertheless, the transparent film sheet may be thermally shrunk due to the application of the heating temperature. Of course, when the transparent film sheet is subjected to the thermal shrinkage, the color image, formed on the microcapsule layer, may be distorted due to the shrinkage of the transparent film sheet. Although the thermal shrinkage of the transparent film sheet can be prevented by increasing a thickness of the transparent film sheet, it is impossible to make the thickness of the transparent film sheet thicker, because the application of the heating temperature to the microcapsules is hindered by the thickened transparent film sheet.

SUMMARY OF THE INVENTION

Therefore, an object of the present invention is to provide an image-forming medium coated with a layer of microcapsules filled with ink associated with an image-formation layer, in which an image can be quickly formed on the image-formation layer at a low cost by selectively squashing and breaking the microcapsules under predetermined temperature/pressure conditions.

Another object of the present invention is to provide an image-forming medium as mentioned above, in which the image-formation layer is closely covered with a sheet of transparent film sheet such that the transparent film sheet cannot be subjected to any thermal shrinkage when the microcapsules are selectively squashed and broken under the predetermined temperature/pressure conditions.

In accordance with a first aspect of the present invention, there is provided an image-forming medium comprising a transparent base member, an image-formation layer coated over the transparent base member, and a layer of microcapsules, coated over the image-formation layer. In this case, an image is formed as a mirror image on the microcapsule layer by the discharged first single-color ink, and is observed through the intermediary of the transparent film sheet.

In accordance with a second aspect of the present invention, there is provided an image-forming medium comprising a base member, a layer of microcapsules coated over the base member, and an image-formation layer coated over the microcapsule layer. In this case, an image is formed as a mirror image on the microcapsule layer by the discharged first single-color ink, and is observed from a side of the image-formation layer opposed to the microcapsule layer.

In any event, according to the present invention, the microcapsule layer contains a first type of microcapsule, filled with a first single-color ink, which exhibits a first temperature/pressure characteristic such that each microcapsule is squashed under a first predetermined pressure at a first predetermined temperature, whereby the first single-color ink is discharged from the squashed microcapsule. The image-formation layer is constituted such that the discharged first single-color ink is developed in the image-formation layer.

The microcapsule layer may further contain a second type of microcapsule, filled with a second single-color ink, which exhibits a second temperature/pressure characteristic such that each microcapsule is squashed under a second predetermined pressure at a second predetermined temperature, whereby the second single-color ink is discharged from the squashed microcapsule, the discharged second single-color ink being developed in the image-formation layer.

Furthermore, the microcapsule layer may contain a third type of microcapsule, filled with a third single-color ink, which exhibits a third temperature/pressure characteristic such that each microcapsule is squashed under a third predetermined pressure at a third predetermined temperature, whereby the third single-color ink is discharged from the squashed microcapsule, the discharged third single-color ink being developed in the image-formation layer.

Preferably, the first, second and third single-color inks form three primary colors, such as cyan, magenta and yellow.

The image-formation layer may be formed as a porous layer comprising white powder, and the development of the discharged first single-color ink in the image-formation layer is carried out by permeation of the discharged first single-color ink into the porous layer. Preferably, the white powder is selected from the group consisting of calcium carbonate powder, titanium dioxide powder, silica powder and white clay powder.

The image-formation layer may have a thickness of about 0.02 mm to about 0.1 mm. In the first aspect of the present invention, the transparent base member may be formed as a sheet of transparent synthetic resin film having a thickness of about 0.2 mm. Preferably, the transparent synthetic resin film sheet is formed of polyethylene terephthalate.

In the first aspect of the present invention, the image-forming medium may further comprises a sheet of protective synthetic resin film covering the microcapsule layer and having a thickness thinner than that of the transparent synthetic resin film sheet. Also, in the second aspect of the present invention, the base member may be formed as a sheet of protective synthetic resin film covering the microcapsule layer.

The protective synthetic resin film sheet may be formed of polyethylene terephthalate, and has a thickness of about 0.025 mm. Preferably, the protective synthetic resin film sheet is colored white. Further, the protective synthetic resin film sheet may be formed as a metallized film sheet.

Each of the first, second and third single-color inks may be composed of a leuco-pigment. In this case, the image-formation layer contains a color developer, with which a discharged single-color ink is chemically reacted to develop a given single color in the image-formation layer. Optionally, the image-formation layer may be formed as a solid color developer layer, with which a discharged single-color ink is chemically reacted to develop a given single-color in the image-formation layer.

BRIEF DESCRIPTION OF THE DRAWINGS

These objects and other objects of the present invention will be better understood from the following description, with reference to the accompanying drawings in which.

DESCRIPTION OF THE PREFERRED EMBODIMENTS

Figure 1:
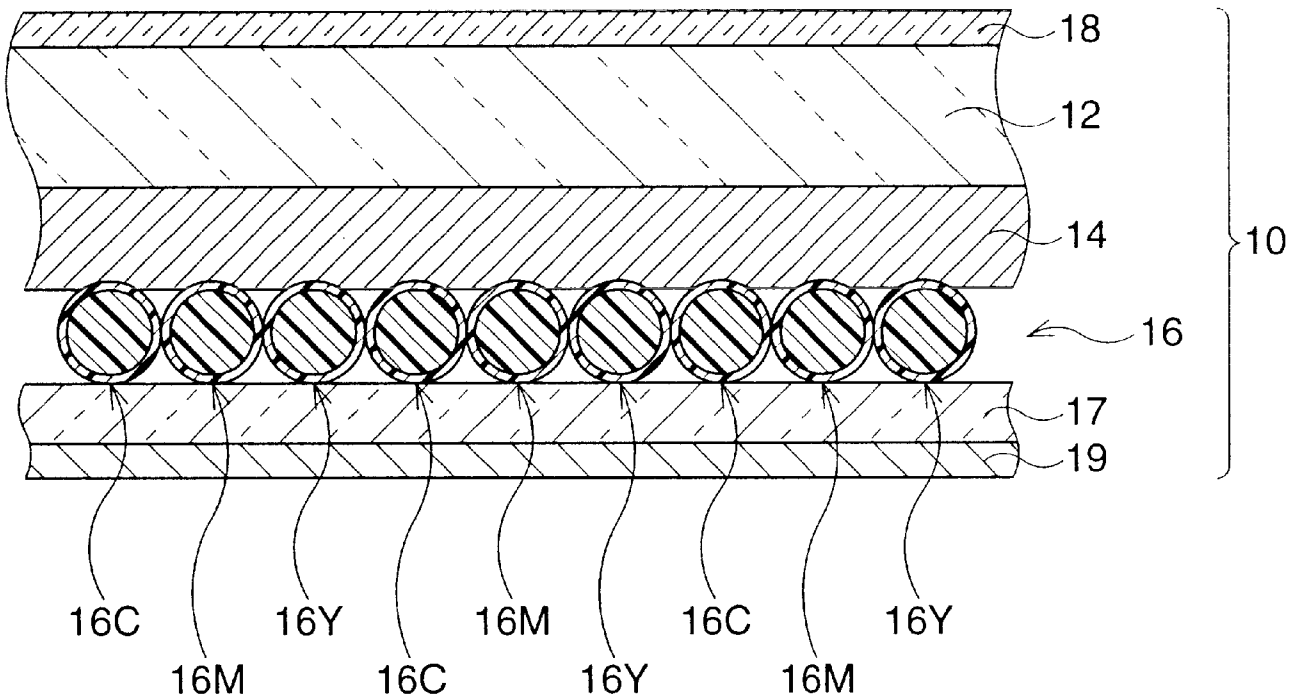
FIG. 1 is a schematic conceptual cross sectional view showing an embodiment of an image-forming medium, according to the present invention, coated with a layer of microcapsules associated with an image-formation layer, the microcapsule layer including a first type of microcapsule filled with a wax-type cyan ink, a second type of microcapsule filled with a wax-type magenta ink and a third type of microcapsule filled with a wax-type yellow ink.

FIG. 1 shows an embodiment of an image-forming medium, generally indicated by reference numeral 10, which is produced in a form of a sheet having a multi-ply structure. Namely, the image-forming medium 10 comprises a sheet of transparent film 12, an image-formation layer 14 coated over a surface of the transparent film sheet 12, a layer of microcapsules 16 coated over a surface of the image-formation layer 14, and a sheet of protective film 17 covering the microcapsule layer 16.

The transparent film sheet 12 is formed of a suitable synthetic resin, such as polyethylene terephthalate (PET), and may have a thickness of about 0.2 mm. The image-formation layer 14, which may have a thickness of about 0.03 mm to about 0.1 mm, is formed of a suitable white powder, such as calcium carbonate powder, titanium dioxide powder, silica powder, white clay powder or the like.

For the formation of the image-formation layer 14 having the thickness of about 0.03 mm to about 0.1 mm, for example, 20 g of either titanium dioxide powder or calcium carbonate powder is mixed with 100 g of 3 wt.% aqueous solution of polyvinyl alcohol (PVA) exhibiting a polymerization degree of 2000, containing a small quantity of dispersant (such as dodecyl benzenesulfonic sodium), and the transparent film sheet 12 is coated with the mixture by utilizing a spray gun or a bar coater.

Then, the coated layer is dried, whereby the image-formation layer 14 is produced as a porous layer, because the titanium dioxide powder cannot be soluble in the aqueous solution of PVA. Thus, the image-formation layer 14 exhibits a permeability to a liquid-phase ink, due to the porosity thereof.

Note, an aqueous solution of gum arabic may be substituted for the aqueous solution of PVA.

In this embodiment, the microcapsule layer 16 includes three types of microcapsules: a first type of microcapsule 16C filled with a wax-type cyan ink, a second type of microcapsule 16M filled with a wax-type magenta ink, and a third type of microcapsule 16Y filled with a wax-type yellow ink, and the three types of microcapsules 16C, 16M and 16Y are uniformly distributed in the microcapsule layer 16. Each type of microcapsule (16C, 16M, 16Y) may have an average diameter of several microns, for example, $5\mu$ to $10\mu$.

Of course, each type of solid-phase ink exhibits a solid-phase at a normal ambient temperature, but it is thermally melted at a predetermined temperature. Also, each type of microcapsule (16C, 16M, 16Y) is constituted so as to be squashed and broken under a predetermined pressure when a solid-phase ink encapsulated in the microcapsule concerned is thermally melted, as discussed in detail hereinafter. Thus, it is possible to selectively squash and break the three types of microcapsules 16C, 16M and 16Y under predetermined temperature/pressure conditions.

When a microcapsule (16C, 16M, 16Y) is squashed and broken, a thermally-melted ink or liquid-type ink is discharged from the broken microcapsule, and the liquid-type ink is permeated into the image-formation layer 14, due to the permeability thereof. Accordingly, it is possible to form and develop a color image on the image-formation layer 14 by selectively squashing and breaking the microcapsules 16C, 16M and 16Y in accordance with color image information.

The protective film sheet 17 is formed of a suitable synthetic resin, such as polyethylene terephthalate (PET). In order to carry out the selective squashing and breaking of the microcapsules 16C, 16M and 16Y, both a heating temperature and a breaking pressure are exerted on the microcapsule layer 16 by pressing a thermal printing-head against the protective film sheet 17, as discussed in detail hereinafter.

In the first embodiment, the protective film sheet 17 may have a thickness of, for example, 0.025 mm, which is thinner than that of the transparent film sheet 12. Thus, it is possible to effectively perform the exertion of both the heating temperature and the breaking pressure on the microcapsule layer 16 through the intermediary of the protective film sheet 17. Due to the existence of the protective film sheet 17, not only can the microcapsule layer 16 be prevented from being subjected to scratches, but also the thermal printing head can be protected from being stained by the discharged liquid-phase ink.

Note, in FIG. 1, although the protective film sheet 17 is illustrated as a transparent film sheet, it can be colored with a suitable pigment, preferably a white pigment.

Optionally, the image-forming medium 10 may be provided with a transparent ultraviolet barrier layer 18 coated over an outer surface of the transparent film sheet 12. Of course, a preservation of a color image, formed and developed on the image-formation layer 14, can be considerably improved due to the existence of the ultraviolet barrier layer 18. Namely, by the ultraviolet barrier layer 18, the formed color image can be prevented from deteriorating due to ultraviolet light. The ultraviolet barrier layer 18 may be interleaved between the transparent film sheet 12 and the image-formation layer 14.

Also, optionally, the image-forming medium 10 may be provided with an anti-sticking layer 19 coated over an outer surface of the protective film layer 17. The anti-sticking layer 19 is used to prevent the protective film layer 17 from sticking to the heated thermal printing head.

For the uniform formation of the microcapsule layer 16, for example, the same amounts of cyan, magenta and yellow microcapsules 16C, 16M and 16Y are homogeneously mixed with a suitable wax-type binder solution to form a suspension, and the transparent film sheet 12 is coated with the wax-type binder solution, containing the suspension of microcapsules 16C, 16M and 16Y. In FIG. 1, for the convenience of illustration, although the microcapsule layer 16 is shown as having a thickness corresponding to the diameter of the microcapsules 16C, 16M and 16Y, in reality, the three types of microcapsules 16C, 16M and 16Y overlay each other, and thus the layer of microcapsules 16 has a larger thickness than the diameter of a single microcapsule (16C, 16M, 16Y).

In each type of microcapsule (16C, 16M, 16Y), a solid-phase ink is composed of a monochromatic pigment, and a vehicle for dispersing the pigment. The solid-phase ink may be formed as a wax-type ink. In this case, the vehicle comprises a suitable wax material, such as carnauba wax, olefin wax, polypropylene wax, microcrystalline wax, paraffin wax, montan wax or the like. Also, the vehicle may comprise a suitable low-melting thermoplastic resin, such as ethylene-vinyl acetate copolymer (EVA), polyethylene, polyester, styrene-methylmethacrylate copolymer.

In this embodiment, for the wax-type cyan ink of the first type of microcapsule 16C, carnauba wax is utilized as a vehicle, and a cyan pigment, such as phthalocyanine blue, is incorporated in the carnauba wax. As shown in a graph of FIG. 2, the carnauba wax, and therefore the carnauba-wax-type cyan ink, exhibits a characteristic curve of a coefficient of elasticity, indicated by reference $E_c$, with respect to a variation in temperature. Namely, the carnauba-wax-type cyan ink is thermally plasticized at a temperature from about 70° C. to about 75° C., and is completely and thermally melted at a temperature of about 83° C.

Figure 2:
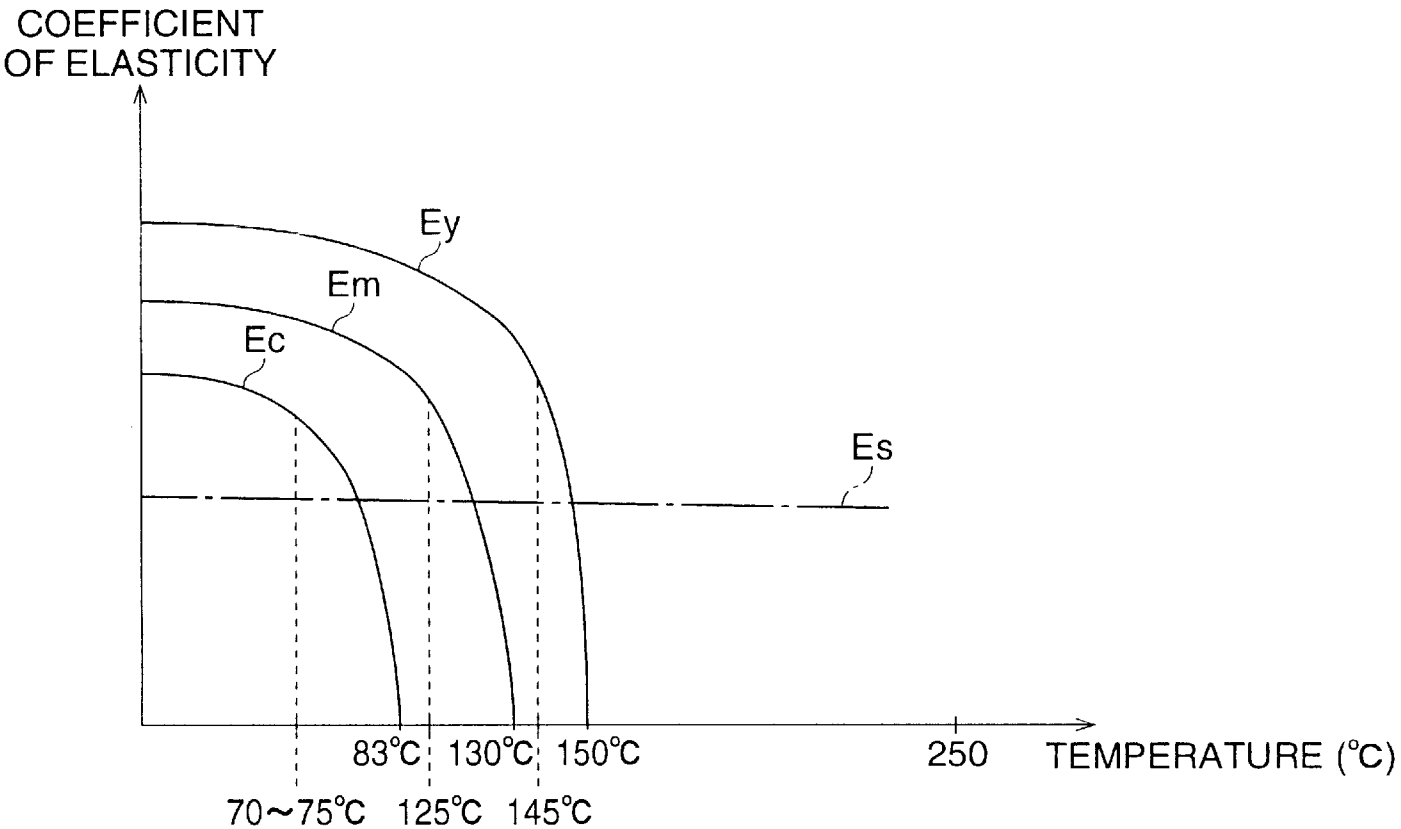
FIG. 2 is a graph showing characteristic curves of longitudinal elasticity coefficients of the wax-type cyan ink, wax-type magenta ink, and wax-type yellow ink of the first, second and third types of microcapsules shown in FIG. 1.

Also, for the solid magenta ink of the second type of microcapsule 16M, olefin wax is utilized as a vehicle, and a magenta pigment, such as rhodamine lake T, is incorporated in the olefin wax. As shown in the graph of FIG. 2, the olefin wax, and therefore the olefin-wax-type magenta ink, exhibits a characteristic curve of a coefficient of elasticity, indicated by reference $E_m$, with respect to a variation in temperature. Namely, the olefin-wax-type magenta ink is thermally plasticized at a temperature of about 125° C., and is completely and thermally melted at a temperature of about 130° C.

Further, for the solid yellow ink of the third type of microcapsule 16Y, polypropylene wax is utilized as a vehicle, and a yellow pigment, such as benzine yellow G, is incorporated in the polypropylene wax. As shown in the graph of FIG. 2, the polypropylene wax, and therefore polypropylene-wax-type yellow ink exhibits a characteristic curve of a coefficient of elasticity, indicated by reference $E_y$, with respect to a variation in temperature. Namely, the polypropylene-wax-type yellow ink is thermally plasticized at a temperature of about 145° C., and is completely and thermally melted at a temperature of about 150° C.

On the other hand, in each type of microcapsule (16C, 16M, 16Y), a shell of a microcapsule may be formed of a suitable thermosetting resin such as melamine resin, urea resin or the like. Optionally, for the shell material of each type of microcapsule (16C, 16M, 16Y), a suitable thermoplastic resin exhibiting a relatively high-melting point, e.g. more than 250° C., such as polyamide, polyimide or the like, may be utilized. Further, optionally, for the shell material of each type of microcapsule (16C, 16M, 16Y), it is possible to utilize a suitable inorganic material exhibiting white, such as titanium dioxide, silica or the like.

In the first embodiment, the shell of each type of microcapsule (16C, 16M, 16Y) is formed of melamine resin. As shown in the graph of FIG. 2, the melamine resin exhibits a characteristic curve of a coefficient of elasticity, indicated by reference $E_s$, with respect to a variation in a temperature. Namely, the coefficient of elasticity of the melamine resin is substantially constant with respect to a variation in temperature over a range between 0° C. and 250° C.

Figure 3:
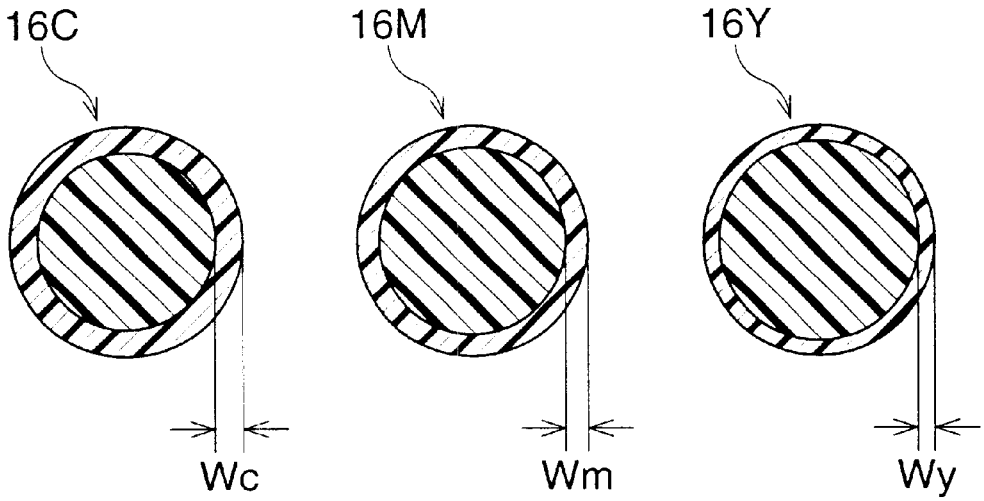
FIG. 3 is a schematic cross-sectional view showing different shell thicknesses of the first, second and third types of microcapsules shown in FIG. 1.

In the first embodiment, although the shells of the three types of microcapsules 16C, 16M and 16Y are formed of the melamine resin, the shells of the cyan microcapsule 16C, magenta microcapsule 16M, and yellow microcapsule 16Y have differing shell thicknesses $W_c$, $W_m$ and $W_y$, respectively, as shown in FIG. 3. The shell thickness $W_c$ of cyan microcapsule 16C is thicker than the shell thickness $W_m$ of the magenta microcapsule 16M, and the shell thickness $W_m$ of the magenta microcapsule 16M is thicker than the shell thickness $W_y$ of the yellow microcapsule 16Y.

Each type of microcapsules (16C, 16M, 16Y) can endure a considerably high pressure without being squashed and broken as long as a corresponding wax-type ink, encapsulated therein, exhibits a solid-phase under a normal ambient temperature. Nevertheless, each microcapsule (16C, 16M, 16Y) is easily squashed and broken by a relatively low pressure when the corresponding wax-type ink is heated so as to be thermally melted, i.e. when the solid phase of the wax-type ink is changed into a liquid phase.

In the first embodiment, the shell thickness $W_c$ of the cyan microcapsules 16C is selected such that each cyan microcapsule 16C is squashed and broken under a pressure more than a predetermined critical pressure 2.0 MPa when each cyan microcapsule 16C is heated to a temperature between the melting point (about 83° C.) of the cyan solid ink and the melting point (about 125° C.) of the magenta solid ink.

Also, the shell thickness $W_m$ of the magenta microcapsules 16M is selected such that each magenta microcapsule 16M is squashed and broken under a pressure that lies between a predetermined critical pressure of 0.2 MPa and the predetermined critical pressure 2.0 MPa when each magenta microcapsule 16M is heated to a temperature between the melting point (about 125° C.) of the magenta solid ink and the melting point (about 145° C.) of the yellow solid ink.

Similarly, the shell thickness $W_y$ of the yellow microcapsules 16Y is selected such that each yellow microcapsule 16Y is squashed and broken under a pressure that lies between a predetermined critical pressure of 0.02 MPa and the predetermined critical pressure 0.2 MPa when each yellow microcapsule 16Y is heated to a temperature more than the melting point (about 145° C.) of the yellow solid ink.

Figure 4:
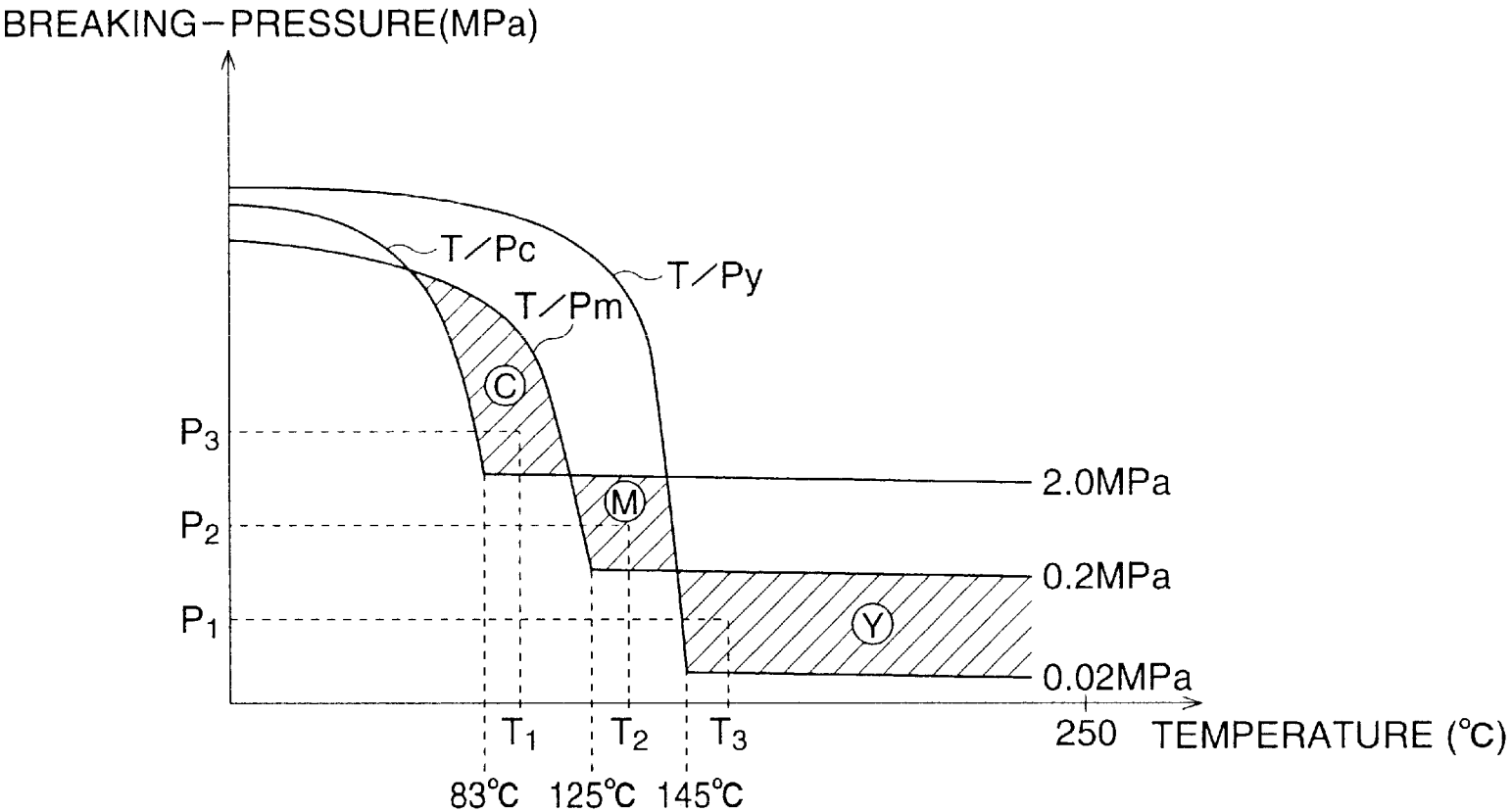
FIG. 4 is a graph showing temperature/pressure breaking characteristics of the first, second and third types of microcapsules shown in FIG. 1, with each of a cyan-developing zone, a magenta-developing zone and a yellow-developing zone being indicated as a hatched zone.

Thus, as shown in a graph of FIG. 4, it is possible to obtain a temperature/pressure breaking characteristic $T/P_c$ of the first type of microcapsule 16C, a temperature/pressure breaking characteristic $T/P_m$ of the second type of microcapsule 16M and a temperature/pressure breaking characteristic $T/P_y$ of the third type of microcapsule 16Y, and a hatched cyan-developing zone C, a hatched magenta-developing zone M and a hatched yellow-developing zone Y are defined by the characteristics $T/P_c$, $T/P_m$ and $T/P_y$.

Accordingly, by suitably selecting a heating temperature and a breaking pressure, which should be locally exerted on the image-forming medium 10, it is possible to selectively squash and break the cyan, magenta and yellow microcapsules 16C, 16M and 16Y at the localized area of the image-forming medium 10 on which the heating temperature and the breaking pressure are exerted.

In particular, as shown in FIG. 4, for example, if a heating temperature $T_1$ and a breaking pressure $P_3$, which should be locally exerted on the image-forming medium 10, are selected so as to fall within the hatched cyan-developing zone C, only the cyan microcapsules 16C are squashed and broken at the localized area of the image-forming medium 10 on which the heating temperature $T_1$ and the breaking pressure $P_3$ are exerted, resulting in discharge of the molten cyan ink or liquid-phase cyan ink from the squashed and broken microcapsules 16C.

At this time, both the solid-phase magenta ink and the solid-phase yellow ink, encapsulated in the respective microcapsules 16M and 16Y, cannot be thermally melted due to the heating temperature $T_1$ being lower than the melting point (about 125° C.) of the solid-phase magenta ink, and thus the microcapsules 16M and 16Y cannot be squashed and broken, due to the solidity of the magenta and yellow inks, even though the shell thicknesses $W_m$ and $W_y$ thereof are thinner than the shell thickness $W_c$ of the cyan microcapsule 16C.

The discharged liquid-phase cyan ink is locally permeated into the image-formation layer 14, whereby the locally-permeated area of the image-formation layer 14 is colored cyan, and the cyan-colored area can be observed through the intermediary of the transparent film sheet 12 and the ultraviolet barrier layer 18.

Also, as shown in FIG. 4, if a heating temperature $T_2$ and a breaking pressure $P_2$, which should be locally exerted on the image-forming medium 10, are selected so as to fall within the hatched magenta-developing zone M, only the magenta microcapsules 16M are squashed and broken at the localized area of the image-forming medium 10 on which the heating temperature $T_2$ and the breaking pressure $P_2$ are exerted, resulting in discharge of the molten magenta ink or liquid-phase magenta ink from the squashed and broken microcapsules 16M.

At this time, although the solid-phase cyan ink, encapsulated in the microcapsule 16C, is thermally melted, the cyan microcapsule 16C cannot be squashed and broken due to the shell thickness $W_c$ thereof being thicker than the shell thickness $W_m$ of the magenta microcapsule 16M. Also, the solid-phase yellow ink, encapsulated in the yellow microcapsule 16Y, cannot be thermally melted due to the heating temperature $T_2$ being lower than the melting point (about 145° C.) of the yellow solid ink, and thus the yellow microcapsule 16Y cannot be squashed and broken, due to the solidity of the yellow ink, even though the shell thickness $W_y$ thereof is thinner than the shell thickness $W_m$ of the magenta microcapsule 16M.

The discharged liquid-phase magenta ink is locally permeated into the image-formation layer 14, whereby the locally-permeated area of the image-formation layer 14 is colored magenta, and the magenta-colored area can be observed through the intermediary of the transparent film sheet 12 and the ultraviolet barrier layer 18.

Further, as shown in FIG. 4, if a heating temperature $T_3$ and a breaking pressure $P_1$, which should be locally exerted on the image-forming medium 10, are selected so as to fall within the hatched yellow-developing zone Y, only the yellow microcapsules 16Y are squashed and broken at the localized area of the image-forming medium 10 on which the heating temperature $T_3$ and the breaking pressure $P_1$ are exerted, resulting in discharge of the molten yellow ink or liquid-phase yellow ink from the squashed and broken microcapsules 16Y.

At this time, although both the solid-phase cyan ink and solid-phase magenta ink, encapsulated in the cyan and magenta microcapsules 16C and 16M are thermally melted, the cyan and magenta microcapsules 16C and 16M cannot be squashed and broken due to the shell thicknesses $W_c$ and $W_m$ thereof being thicker than the shell thickness $W_y$ of the yellow microcapsule 16Y.

The discharged liquid-phase yellow ink is locally permeated into the image-formation layer 14, whereby the locally-permeated area of the image-formation layer 14 is colored yellow, and the yellow-colored area can be observed through the intermediary of the transparent film sheet 12 and the ultraviolet barrier layer 18.

Accordingly, if the selection of a heating temperature and a breaking pressure, which should be locally exerted on the image-forming medium 10, are suitably controlled in accordance with digital color image-pixel signals: digital cyan image-pixel signals, digital magenta image-pixel signals and digital yellow image-pixel signals, it is possible to form a color image on the image-formation layer 14 on the basis of the digital color image-pixel signals.

Note, in the first embodiment, the heating temperatures $T_1$, $T_2$ and $T_3$ may be 85° C., 135° C. and 160° C., respectively, and the breaking pressures $P_1$, $P_2$ and $P_3$ may be 0.1 MPa, 1.0 MPa and 3.0 MPa, respectively.

Note, to produce each of the types of microcapsules 16C, 16M and 16Y, a polymerization method, such as interfacial polymerization, in-situ polymerization or the like, may be utilized.

Figure 5:
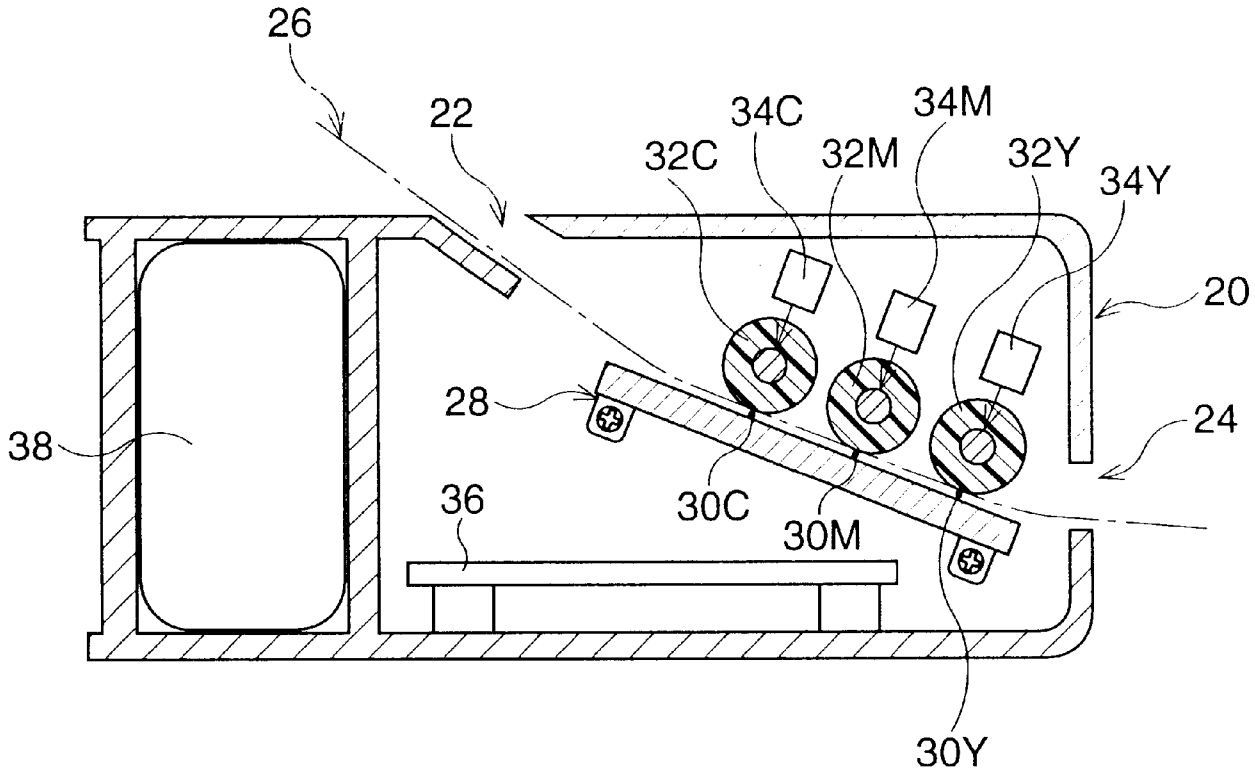
FIG. 5 is a schematic cross-sectional view of a line type color printer for forming and recording a color image on the image-formation layer of the image-forming medium shown in FIG. 1.

FIG. 5 schematically shows a color printer, which is constituted as a line printer so as to form a color image on the image-forming medium 10.

The color printer comprises a rectangular parallelepiped housing 20 having an entrance opening 22 and an exit opening 24 formed in a top wall and a side wall of the housing 20, respectively. The image-forming medium 10 is introduced into the housing 20 through the entrance opening 22, and is then discharged from the exit opening 24 after the formation of a color image on the image-forming medium 10. Note, in FIG. 5, a path 26 for movement of the medium 10 is indicated by a single-chained line.

A guide plate 28 is provided in the housing 20 so as to define a part of the path 26 for the movement of the image-forming medium 10, and a first thermal head 30C, a second thermal head 30M and a third thermal head 30Y are securely attached to a surface of the guide plate 28. Each thermal head (30C, 30M, 30Y) is formed as a line thermal head perpendicularly extended with respect to a direction of the movement of the image-forming medium 10.

Figure 6:
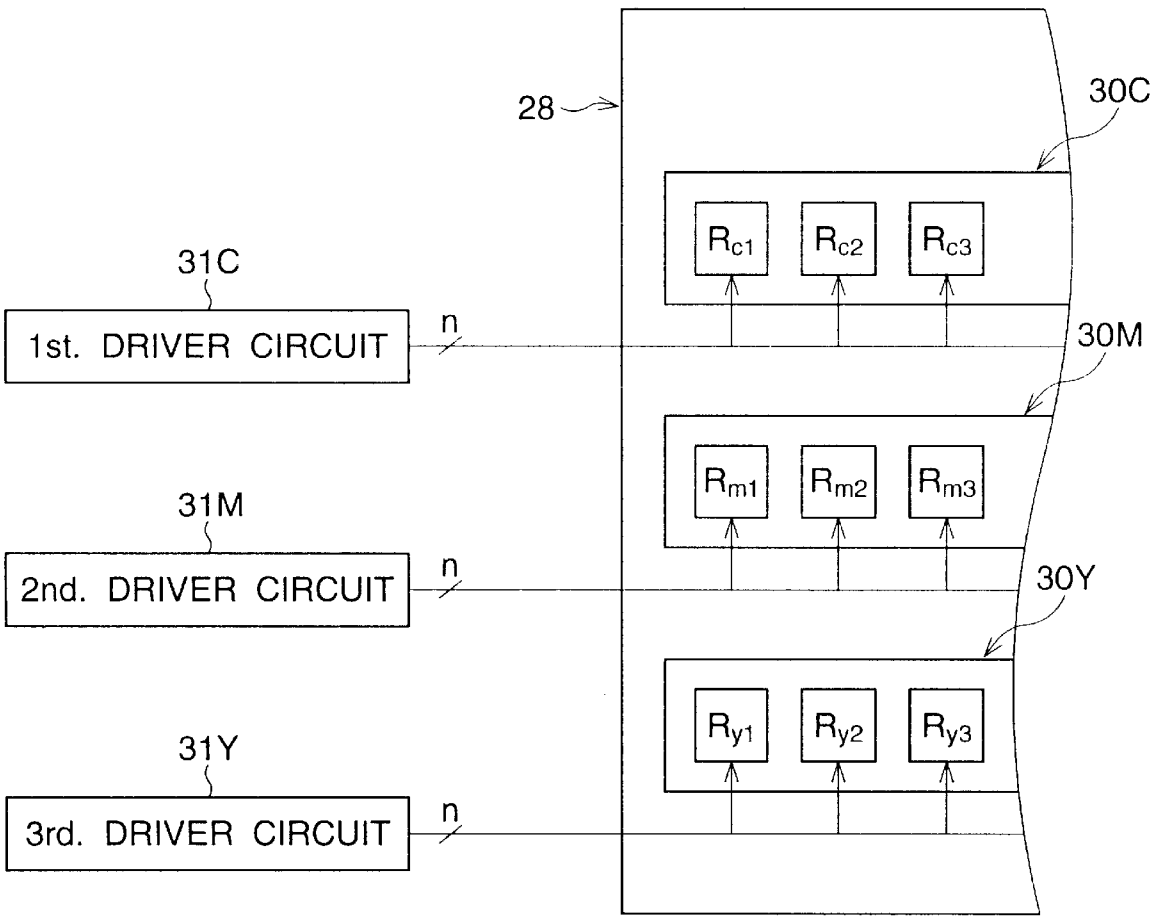
FIG. 6 is a partial schematic block diagram of three line type thermal heads and three driver circuits therefor incorporated in the line type color printer of FIG. 5.

As shown in FIG. 6, the line thermal head 30C includes a plurality of heater elements or electric resistance elements $R_{c1}$ to $R_{cn}$ and these resistance elements are aligned with each other along a length of the line thermal head 30C. The electric resistance elements $R_{c1}$ to $R_{cn}$ are selectively and electrically energized by a first driver circuit 31C in accordance with a single-line of cyan image-pixel signals, and the electrically-energized elements are heated to the temperature $T_1$ (85° C.).

Also, the line thermal head 30M includes a plurality of heater elements or electric resistance elements $R_{m1}$, to $R_{mn}$ and these resistance elements are aligned with each other along a length of the line thermal head 30M. The electric resistance elements $R_{m1}$ to $R_{mn}$ are selectively and electrically energized by a second driver circuit 31M in accordance with a single-line of magenta image-pixel signals, and the electrically-energized elements are heated to the temperature $T_2$ (135° C.).

Further, the line thermal head 30Y includes a plurality of heater elements or electric resistance elements $R_{y1}$ to $R_{yn}$, and these resistance elements are aligned with each other along a length of the line thermal head 30Y. The electric resistance elements $R_{y1}$ to $R_{yn}$ are selectively and electrically energized by a third driver circuit 31Y in accordance with a single-line of yellow image-pixel signals, and the electrically-energized elements are heated to the temperature $T_3$ (160° C.).

Note, in the color printer shown in FIG. 5, the line thermal heads 30C, 30M and 30Y are arranged in sequence so that the respective heating temperatures increase in the movement direction of the image-forming medium 10.

The color printer further comprises a first roller platen 32C, a second roller platen 32M and a third roller platen 32Y associated with the first, second and third thermal heads 30C, 30M and 30Y, respectively, and each of the roller platens 32C, 32M and 32Y may be formed of a suitable hard rubber material. The first roller platen 32C is provided with a first spring-biasing unit 34C so as to be elastically pressed against the first thermal head 30C at the breaking-pressure $P_3$ (3.0 MPa); the second roller platen 32M is provided with a second spring-biasing unit 34M so as to be elastically pressed against the second thermal head 30M at the breaking-pressure $P_2$ (1.0 MPa); and the third roller platen 32Y is provided with a third spring-biasing unit 34Y so as to be elastically pressed against the third thermal head 30Y at the breaking-pressure $P_1$ (0.1 MPa).

Note, the roller platens 32C, 32M and 32Y are arranged in sequence so that the respective pressures, exerted by the roller platens 32C, 32M and 32Y, decrease in the movement direction of the image-forming medium 10.

In FIG. 5, reference 36 indicates a control circuit board for controlling a printing operation of the color printer, and reference 38 indicates an electrical main power source for electrically energizing the control circuit board 36.

During a printing operation, the respective roller platens 32C, 32M and 32Y are rotated in a counterclockwise direction (FIG. 5) by three motors (not shown), respectively, with a same peripheral speed under control of the control circuit board 36, so that the image-forming medium 10, which is introduced into the entrance opening 22, moves toward the exit opening 24 along the path 26. Note, the introduction of the image-forming medium 10 is performed such that the anti-sticking layer 19 thereof is in direct contact with the thermal heads 30C, 30M and 30Y.

Thus, during the movement of the image-forming medium 10, the image-forming medium 10 is subjected to the breaking-pressure $P_3$ (3.0 MPa) when passing between the first line thermal head 30C and the first roller platen 32C; the image-forming medium 10 is subjected to the breaking-pressure $P_2$ (1.0 MPa) when passing between the second line thermal head 30M and the second roller platen 32M; and the image-forming medium 10 is subjected to the breaking-pressure $P_1$ (0.1 MPa) when passing between the third line thermal head 30Y and the third roller platen 32Y.

While the image-forming medium 10 passes between the first line thermal head 30C and the first roller platen 32C, the selective energization of the electric resistance elements $R_{c1}$ to $R_{cn}$ is performed in accordance with a single-line of cyan image-pixel signals under control of the control circuit board 36, and the electrically-energized elements are heated to the temperature $T_1$ (85° C.), resulting in the production of a cyan dot on the image-formation layer 14 due to the breakage of only cyan microcapsules 16C, which are locally heated by an electrically-energized resistance element.

Similarly, while the image-forming medium 10 passes between the second line thermal head 30M and the second roller platen 32M, the selective energization of the electric resistance elements $R_{m1}$ to $R_{mn}$ are performed in accordance with a single-line of magenta image-pixel signals under control of the control circuit board 36, and the electrically-energized elements are heated to the temperature $T_2$ (135° C.), resulting in the production of a magenta dot on the image-formation layer 14 due to the breakage of only magenta microcapsules 16M, which are locally heated by an electrically-energized resistance element.

Further, while the image-forming medium 10 passes between the third line thermal head 30Y and the third roller platen 32Y, the selective energization of the electric resistance elements $R_{y1}$ to $R_{yn}$ are performed in accordance with a single-line of yellow image-pixel signals under control of the control circuit board 36, and the electrically-energized elements are heated to the temperature $T_3$ (160° C.), resulting in the production of a yellow dot on the image-formation layer 14 due to the breakage of only yellow microcapsules 16Y, which are locally heated by an electrically-energized resistance element.

Note, the cyan, magenta and yellow dots, produced by the heated resistance elements $R_{cn}$, $R_{mn}$ and $R_{yn}$, have a dot size (diameter) of about 50$\mu$, to about 100$\mu$, and three types of cyan, magenta and yellow microcapsules 16C, 16M and 16Y, having the average diameter of 5$\mu$ to 10$\mu$, are uniformly included in a dot area to be produced on the image-forming medium 10.

Of course, a color image is formed on the image-forming medium 10 on the basis of a plurality of overlaying three-primary color dots obtained by selectively heating the electric resistance elements ($R_{c1}$ to $R_{cn}$; $R_{m1}$ to $R_{mn}$; and $R_{y1}$ to $R_{yn}$)in accordance with three-primary color digital image-pixel signals. Namely, a certain dot of the color image, formed on the image-forming medium 10, is obtained by a combination of overlaying cyan, magenta and yellow dots produced by corresponding electric resistance elements $R_{cn}$, $R_{mn}$ and $R_{yn}$.

The color image is formed as a mirror image on the microcapsule layer 16, because the color image, formed and developed on the image-formation layer 14, is observed through the intermediary of the transparent film sheet 12 and the ultraviolet barrier layer 18. Namely, in the color printer shown in FIG. 5, a frame of digital color (cyan, magenta and yellow) image-pixel signals are processed such that the mirror image is formed on the microcapsule layer 16.

As is apparent from the foregoing, the color image, formed and developed on the image-formation layer 14, can be vividly and sharply observed, because the observation of the color image is performed through the intermediary of the transparent film sheet 12 and the ultraviolet barrier layer 18.

With the arrangement of the image-forming medium 10 as mentioned above, the transparent film sheet 12 cannot be subjected to a thermal shrinkage, because the transparent film sheet 12 is not directly heated by the thermal heads 30C, 30M and 30Y, and because the transparent film sheet 12 can be given a relatively-larger thickness (0.2 mm).

In the first embodiment, although the transparent ultraviolet barrier layer 18 is coated over the transparent film sheet 12, it may be interleaved between the transparent film sheet 12 and the image-formation layer 14, if necessary.

Also, optionally, the protective film layer 17 and the anti-sticking layer 19 may be omitted from the image-forming medium 10, if necessary. Of course, when the omission of the layers 17 and 19 is realized, the outer surface of the microcapsule layer 16 is in direct contact with the thermal heads 30C, 30M and 30Y during the printing operation.

On the other hand, the transparent film sheet 12 and/or the transparent ultraviolet barrier layer 18 may be omitted from the image-forming medium 10. When the omission of the film sheet 12 and/or the barrier layer 18 is realized, the microcapsule layer 16 is formed on the protective film layer 17, and then the image-formation layer 14 is formed on the microcapsule layer 16.

In the first embodiment, suitable leuco-pigments may substituted for the aforementioned cyan, magenta and yellow pigments. As is well-known, a leuco-pigment per se exhibits no color. Namely, usually, the leuco-pigment exhibits milky-white or transparency, and reacts with a color developer, such as zinc salicylate, active white clay and so on, to thereby produce a given single-color (cyan, magenta, yellow). Thus, the color developer must be contained in the image-formation layer 14 when using the leuco-pigments.

For example, Benzoyl leucomethylene blue (BLMB) may be utilized as a cyan-producing leuco-pigment; crystal violet lactone (CVL) may be utilized as a magenta-producing leuco-pigment; and I-3R, available from CIBA SPECIALTY CHEMICALS, may be utilized as a yellow-producing leuco-pigment. Of course, the cyan-producing leuco-pigment is incorporated in the carnauba wax exhibiting the characteristic curve of a coefficient of elasticity $E_c$, the magenta-producing leuco-pigment is incorporated in the olefin wax exhibiting the characteristic curve of a coefficient of elasticity $E_m$, and the yellow-producing leuco-pigment is incorporated in the polypropylene wax exhibiting the characteristic curve of a coefficient of elasticity, indicated by reference $E_y$ (FIG. 2).

The image-formation layer 14 containing the color developer may be formed in substantially the same manner as mentioned above. Namely, for example, a given amount of white titanium dioxide powder and a given amount of zinc salicylate (color developer) are mixed with an aqueous solution of polyvinyl alcohol (PVA), and the transparent film sheet 12 is coated with the mixture. Then, the coated layer is dried, thereby producing the image-formation layer 14 containing the color developer as a porous layer exhibiting a permeability to a liquid-phase ink.

Optionally, the image-formation layer 14 per se may be formed of the color developer without using the white powder. Namely, for example, a given amount of zinc salicylate is mixed with and dissolved in an aqueous solution of polyvinyl alcohol (PVA), and the transparent film sheet 12 is coated with the solution of zinc salicylate. Then, the coated layer is dried, thereby producing the image-formation layer or color developer layer 14, which may have a thickness of about 0.01 mm to about 0.1 mm. In this case, the image-formation layer or color developer layer 14 is obtained as a nonporous or solid layer, because the zinc salicylate is soluble in the aqueous solution of PVA. Nevertheless, a color image can be formed and developed on the solid image-formation layer or color developer layer 14 because a leuco-pigment is chemically reacted therewith. Of course, another alcohol-based solution or a ketone-based solution, in which the zinc salicylate is soluble, may be substituted for the water solution of PVA.

Figure 7:
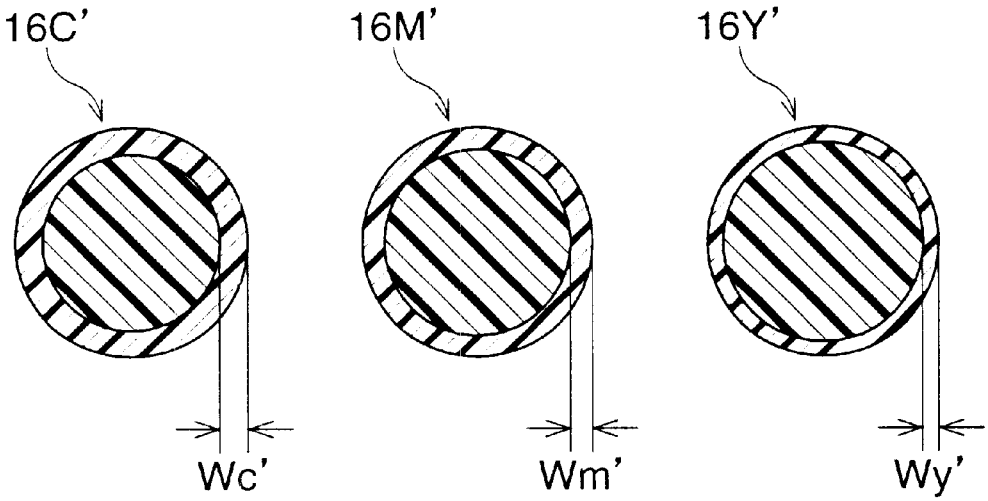
FIG. 7 is a schematic cross-sectional view, similar to FIG. 3, showing a modification of the first, second and third types of microcapsules shown in FIG. 1.

FIG. 7 shows a modification of the cyan, magenta and yellow microcapsules 16C, 16M and 16Y, and the modified cyan, magenta and yellow microcapsules are indicated by references 16C', 16M' and 16Y'. The microcapsule layer 16 may be formed, in substantially the same manner as mentioned above, by using the modified cyan, magenta and yellow microcapsules 16C', 16M' and 16Y'.

In the modification of FIG. 7. for the resin material of each type of microcapsule (16C', 16M', 16Y'), a shape memory resin is utilized. As is well known, for example, the shape memory resin is represented by a polyurethane-based-resin, such as polynorbornene, trans-1,4-polyisoprene polyurethane. As other types of shape memory resin, a polyimide-based resin, a polyamide-based resin, a polyvinyl-chloride-based resin, a polyester-based resin and so on are also known.

Figure 8:
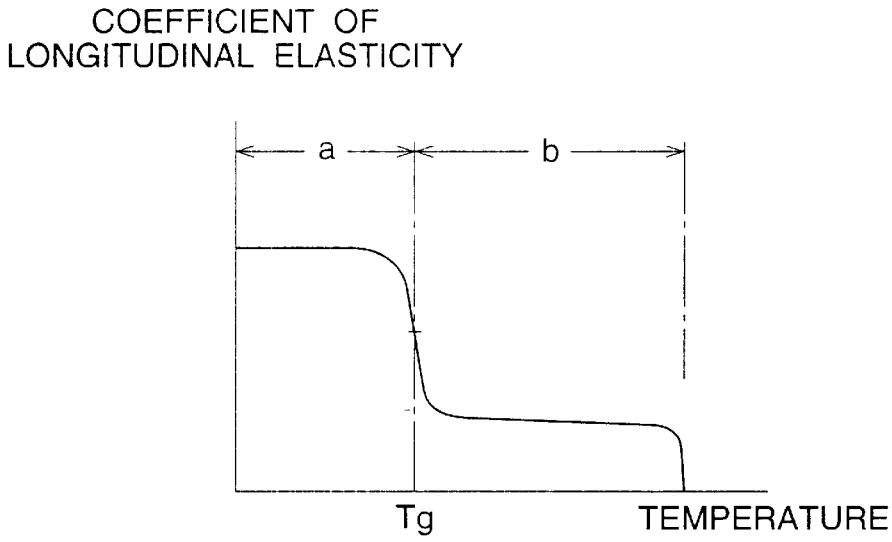
FIG. 8 is a graph showing a characteristic curve of a longitudinal elasticity coefficient of a shape memory resin, which is utilized in a production of the modified first, second and third types of microcapsules shown in FIG. 7.

In general, as is apparent from a graph of FIG. 8, the shape memory resin exhibits a coefficient of longitudinal elasticity, which abruptly changes at a glass-transition temperature boundary $T_g$. In the shape memory resin, Brownian movement of the molecular chains is stopped in a low-temperature area "a", which is less than the glass-transition temperature $T_g$, and thus the shape memory resin exhibits a glass-like phase. On the other hand, Brownian movement of the molecular chains becomes increasingly energetic in a high-temperature area "b", which is higher than the glass-transition temperature $T_g$, and thus the shape memory resin exhibits a rubber elasticity.

The shape memory resin is named due to the following shape memory characteristic: after a mass of the shape memory resin is worked into a shaped article in the low-temperature area "a", when such a shaped article is heated over the glass-transition temperature $T_g$, the article becomes freely deformable. After the shaped article is deformed into another shape, when the deformed article is cooled to below the glass-transition temperature $T_g$, the other shape of the article is fixed and maintained. Nevertheless, when the deformed article is again heated to above the glass-transition temperature $T_g$, without being subjected to any load or external force, the deformed article returns to the original shape.

In the modification of FIG. 7, the shape memory characteristic per se is not utilized, but the characteristic abrupt change of the shape memory resin in the longitudinal elasticity coefficient is utilized, such that the three types of microcapsules 16C', 16M' and 16Y' can be selectively squashed and broken at different temperatures and under different pressures, respectively.

Figure 9:
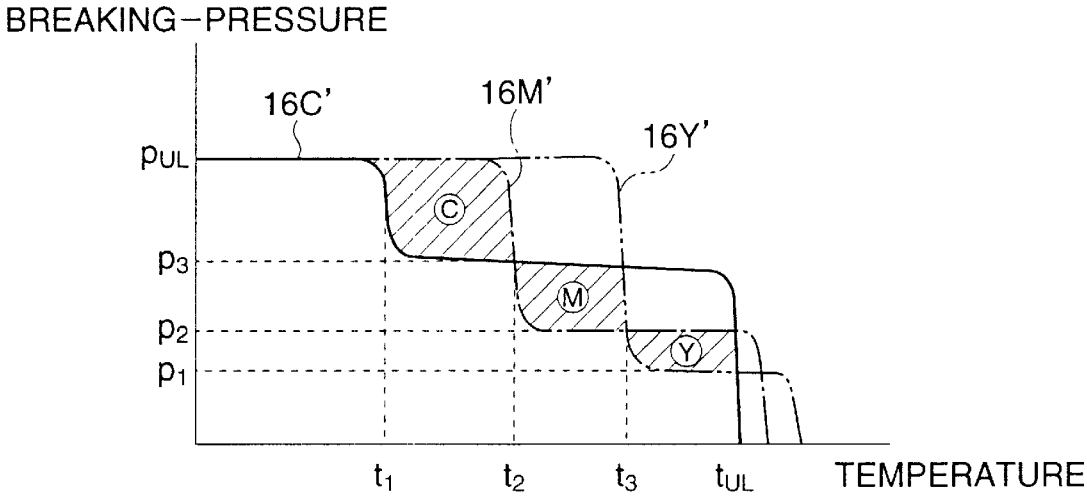
FIG. 9 is a graph showing pressure/temperature breaking characteristics of the respective cyan, magenta and yellow microcapsules shown in FIG. 7, with each of a cyan-developing area, a magenta-developing area and a yellow-developing area being indicated as a hatched area.

As shown in a graph of FIG. 9, a shape memory resin of the cyan microcapsules 16C' is prepared so as to exhibit a characteristic longitudinal elasticity coefficient, indicated by a solid line, having a glass-transition temperature $t_1$; a shape memory resin of the magenta microcapsules 16M' is prepared so as to exhibit a characteristic longitudinal elasticity coefficient, indicated by a single-chained line, having a glass-transition temperature $t_2$; and a shape memory resin of the yellow microcapsules 16Y' is prepared so as to exhibit a characteristic longitudinal elasticity coefficient, indicated by a double-chained line, having a glass-transition temperature $t_3$.

Note, by suitably varying compositions of the shape memory resin and/or by selecting a suitable one from among various types of shape memory resin, it is possible to obtain the respective shape memory resins, with the glass-transition temperatures $t_1$, $t_2$ and $t_3$. For example, the glass-transition temperatures $t_1$, $t_2$ and $t_3$ may be set to 70° C., 110° C. and 130° C., respectively.

Similar to the aforementioned case, the respective cyan, magenta and yellow microcapsules 16C', 16M' and 16Y' may be filled with a wax-type cyan ink, a wax-type magenta ink and a wax-type yellow ink, but these wax-type inks are thermally melted at a temperature less than the lowest glass-transition temperature $t_1$. Namely, in each of the wax-type cyan, magenta and yellow inks, a suitable low-melting wax, exhibiting a melting point less than the glass-transition temperature $t_1$, is utilized as a vehicle in which a single-color (cyan, magenta, yellow) pigment is incorporated. For the low-melting wax, NHP-3 (paraffin wax) exhibiting a melting point 73° C., available from NIHON SEIRHO K.K., may be utilized. Also, for the respective cyan, magenta and yellow pigments, phthalocyanine blue, rhodamine lake T and benzine yellow G may be utilized.

Also, in the modification of FIG. 7, the respective cyan, magenta and yellow microcapsules 16C', 16M' and 16Y' may be filled with a liquid-phase cyan ink, a liquid-phase magenta ink and a liquid-phase yellow ink. Namely, for example, each of the cyan, magenta and yellow pigments (phthalocyanine blue, rhodamine lake T and benzine yellow G) is incorporated in a liquid-phase vehicle, such as 2,7 di-isopropyl naphthalene, which is available as KMC-113 from Rütgers Kureha Solvents (RKS) GmbH.

Further, in the modification of FIG. 7, it is possible to utilize the leuco-pigments (Benzoyl leucomethylene blue (BLMB), crystal violet lactone (CVL) and I-3R). Of course, in this case, the color developer is contained in the image-formation layer 14.

As shown in FIG. 7, the shell walls of the cyan microcapsules 16C', magenta microcapsules 16M', and yellow microcapsules 16Y' have differing thicknesses $W_C'$, $W_M'$ and $W_Y'$, respectively. Namely, the thickness $W_C'$ of cyan microcapsules 16C' is larger than the thickness $W_M'$ of magenta microcapsules 16M', and the thickness $W_M'$ of magenta microcapsules 16M' is larger than the thickness $W_Y'$ of yellow microcapsules 16Y'.

The wall thickness $W_C'$ of the cyan microcapsules 16C' is selected such that each cyan microcapsule 16C' is compacted and broken under a breaking pressure that lies between a critical breaking pressure $p_3$ and an upper limit pressure $p_{UL}$ (FIG. 9), when each cyan microcapsule 16C' is heated to a temperature between the glass-transition temperatures $t_1$ and $t_2$; the wall thickness $W_M'$ of the magenta microcapsules 16M' is selected such that each magenta microcapsule 16M' is compacted and broken under a breaking pressure that lies between a critical breaking pressure $p_2$ and the critical breaking pressure $p_3$ (FIG. 9), when each magenta microcapsule 16M' is heated to a temperature between the glass-transition temperatures $t_2$ and $t_3$; and the wall thickness $W_Y'$ of the yellow microcapsules 16Y' is selected such that each yellow microcapsule 16Y' is compacted and broken under a breaking pressure that lies between a critical breaking pressure $p_1$ and the critical breaking pressure $p_2$ (FIG. 9), when each yellow microcapsule 16Y' is heated to a temperature between the glass-transition temperature $t_3$ and an upper limit temperature $t_{UL}$.

Note, for example, the breaking-pressures $p_1$, $p_2$, $p_3$ and $p_{UL}$ be set to 0.02, 0.2, 2.0 and 20 MPa, respectively, and a wall thickness of a microcapsule (16C', 16M', 16Y') concerned is selected such that it is compacted and broken under a given breaking pressure when it is heated to a given temperature. Note, the upper limit temperature $t_{UL}$ is suitably set to, for example, 150° C.

Thus, by suitably selecting a heating temperature and a breaking pressure, which should be exerted on the image-forming medium 10 featuring the microcapsules 16C', 16M' and 16Y', it is possible to selectively squash and break the cyan, magenta and yellow microcapsules 16C', 16M' and 16Y'.

For example, if the selected heating temperature and breaking pressure fall within a hatched cyan-developing area C (FIG. 9), defined by a temperature ranging between the glass-transition temperatures $t_1$ and $t_2$ and by a pressure ranging between the critical breaking pressure $p_3$ and the upper limit pressure $p_{UL}$, only the cyan microcapsules 16C' are squashed and broken. Also, if the selected heating temperature and breaking pressure fall within a hatched magenta-developing area M, defined by a temperature ranging between the glass-transition temperatures $t_2$ and $t_3$ and by a pressure ranging between the critical breaking pressures $p_2$ and $p_3$, only the magenta microcapsules 16M' are squashed and broken. Further, if the selected heating temperature and breaking pressure fall within a hatched yellow-developing area Y, defined by a temperature ranging between the glass-transition temperature $t_3$ and the upper limit temperature $t_{UL}$ and by a pressure ranging between the critical breaking pressures $p_1$ and $p_2$, only the yellow microcapsules 16Y' are squashed and broken.

Accordingly, if the selection of a heating temperature and a breaking pressure, which should be exerted on the image-forming medium 10 featuring the microcapsules 16C', 16M' and 16Y', are suitably controlled in accordance with a series of digital color (cyan, magenta, yellow) image-pixel signals, it is possible to form a color image on the image-forming sheet 10 on the basis of the digital color image-pixel signals.

Of course, the color printer as shown in FIG. 5 may be utilized for the formation or development of the color image on the image-formation layer 14 of the image-forming medium 10 featuring the microcapsules 16C', 16M' and 16Y'. However, the color printer must be modified in conformance with the temperature/pressure characteristics of the microcapsules 16C', 16M' and 16Y'.

In particular, a heating temperature of the electric resistance elements $R_{c1}$ to $R_{cn}$ of the line thermal head 30C is et as a temperature falling in the range between the glass-transition temperatures $t_1$ and $t_2$, and a breaking pressure, exerted by the spring-biasing unit 34C on the roller platen 32C, is set as a pressure falling in the range between the critical breaking-pressure $p_3$ and the upper limit pressure $p_{UL}$ the critical pressure.

Also, a heating temperature of the electric resistance elements $R_{m1}$ to $R_{mn}$ of the line thermal head 30M is set as a temperature falling in the range between the glass-transition temperatures $t_2$ and $t_3$, and a breaking pressure, exerted by the spring-biasing unit 34M on the roller platen 32M, is set as a pressure falling in the range between the critical breaking-pressures $p_2$ and $p_3$.

Further, a heating temperature of the electric resistance elements $R_{y1}$ to $R_{yn}$ of the line thermal head 30Y is set as a temperature falling in the range between the glass-transition temperature $t_3$ and the upper limit temperature $t_{UL}$, and a breaking pressure, exerted by the spring-biasing unit 34Y on the roller platen 32Y, is set as a pressure falling in the range between the critical breaking-pressures $p_1$ and $p_2$.

Figure 10:
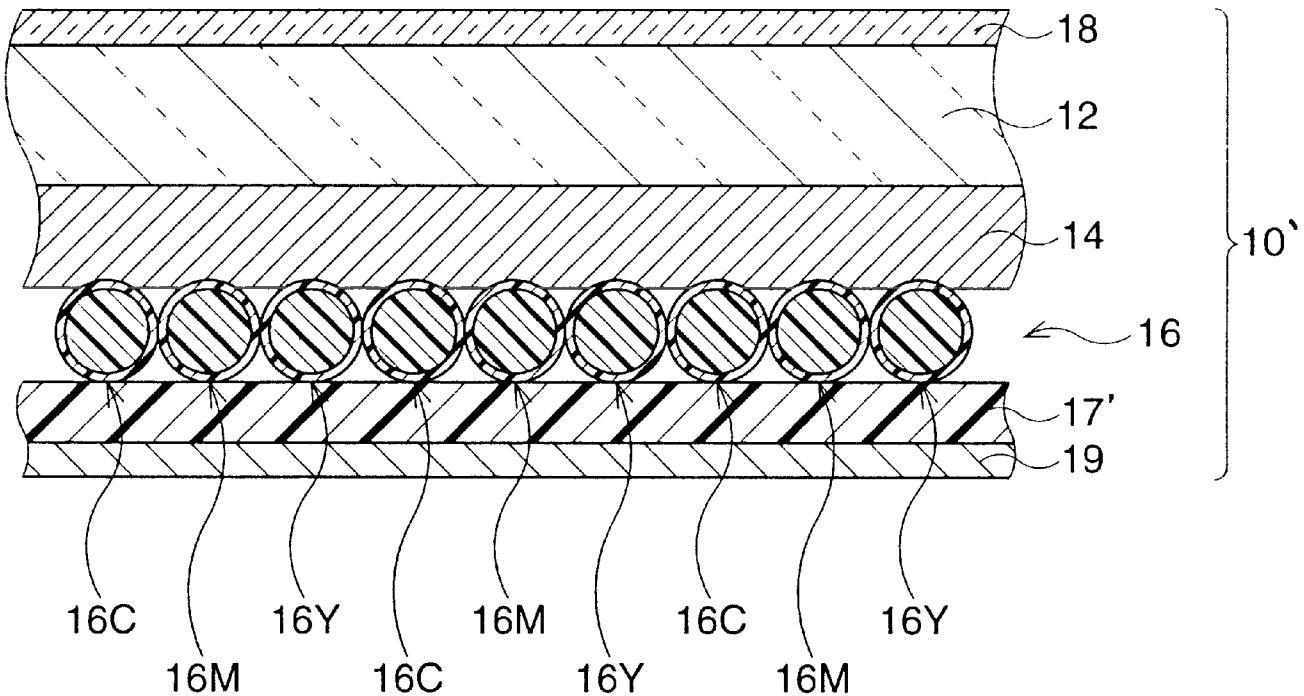
FIG. 10 is a schematic conceptual cross sectional view showing a modification of the embodiment of the image-forming medium shown in FIG. 2.

FIG. 10 shows a modification of the image-forming medium 10, and the modified image-forming medium is generally indicated by reference 10'. Note, in FIG. 10, the features similar to those of FIG. 1 are indicated by the same reference numerals. In the modified image-forming medium 10', a sheet of protective film 17' is colored white so that a color image, formed and developed on the image-formation layer 14, can be distinctly observed.

In particular, light, made incident on the transparent ultraviolet barrier layer 18, is propagated through the transparent film sheet 12, and is then reflected by the image-formation layer 14. Namely, the observation of the color image is performed by sensing the reflected light with the human eye. At this time, a small part of the incident light penetrates and passes through the image-formation layer 14 and the microcapsule layer 16, and is reflected by the white protective film sheet 17' so that the image-formation layer 14 is illuminated with the light reflected by the white protective film sheet 17'. Thus, the color image, developed on the image-formation layer 14, can be distinctly observed due to a back light effect obtained from the illumination of the image-formation layer 14 with the reflected light.

The protective film sheet 17' may be treated, to facilitate a reflectivity of the protective film sheet 17'. For example, the protective film sheet 17' may be formed as a metallized film sheet. Namely, a surface of the film sheet 17' may be coated with a suitable metal film layer, such as a thin aluminum film layer.

Finally, it will be understood by those skilled in the art that the foregoing description is of preferred embodiments of the image-forming medium, and that various changes and modifications may be made to the present invention without departing from the spirit and scope thereof.

The present disclosure relates to subject matters contained in Japanese Patent Application No. 11-045046 (filed on Feb. 23, 1999) which is expressly incorporated herein, by reference, in its entirety.

What is claimed is:

1. An image-forming medium comprising:

a transparent base member;

an image-formation layer coated over said transparent base member; and a layer of microcapsules, coated over said image-formation layer, containing a type of microcapsule filled with a single-pigment ink, said type of microcapsule exhibiting a temperature/pressure characteristic such that each said microcapsule is configured to be squashed under a predetermined pressure at a predetermined temperature, whereupon said single-pigment ink is discharged from the squashed said microcapsule;

wherein said image-formation layer is constituted such that a single color corresponding to the discharged single-pigment ink is developed in the image-formation layer.

2. An image-formation medium as set forth in claim 1, wherein:

said type of microcapsule is a first type of microcapsule;

said temperature/pressure characteristic is a first temperature/pressure characteristic;

said predetermined pressure is a first predetermined pressure;

said predetermined temperature is a first predetermined temperature;

said single-pigment ink is a first single-pigment ink; and said microcapsule layer further contains a second type of microcapsule filled with a second single-pigment ink, which exhibits a second temperature/pressure characteristic such that each microcapsule is squashed under a second predetermined pressure at a second predetermined temperature, whereby said second single-pigment ink is discharged from said squashed microcapsule, the discharged second single-pigment ink being developed in the image-formation layer.

3. An image-forming medium as set forth in claim 2, wherein said microcapsule layer further contains a third type of microcapsule filled with a third single-pigment ink, which exhibits a third temperature/pressure characteristic such that each microcapsule is squashed under a third predetermined pressure at a third predetermined temperature, whereby said third single-pigment ink is discharged from said squashed microcapsule, the discharged third single-pigment ink being developed in the image-formation layer.

4. An image-forming medium as set forth in claim 3, wherein said first, second and third single-pigment inks form three primary colors.

5. An image-forming medium as set forth in claim 1, wherein said image-formation layer is a porous layer comprising white powder, and the development of the discharged single-pigment ink in the image-formation layer is carried out by permeation of the discharged first single-pigment ink into said porous layer.

6. An image-forming medium as set forth in claim 5, wherein said white powder is selected from the group consisting of calcium carbonate powder, titanium dioxide powder, silica powder and white clay powder.

7. An image-forming medium as set forth in claim 6, wherein said image-formation layer has a thickness of about 0.02 mm to about 0.1 mm, and said transparent base member is formed as a sheet of transparent synthetic resin film having a thickness of about 0.2 mm.

8. An image-forming medium as set forth in claim 7, wherein said transparent synthetic resin film sheet is formed of polyethylene terephthalate.

9. An image-forming medium as set forth in claim 7, further comprising a sheet of protective synthetic resin film covering said microcapsule layer and having a thickness thinner than that of said transparent synthetic resin film sheet.

10. An image-forming medium as set forth in claim 9, wherein said protective synthetic resin film sheet is formed of polyethylene terephthalate, and has a thickness of about 0.025 mm.

11. An image-forming medium as set forth in claim 9, wherein said protective synthetic resin film sheet is colored white.

12. An image-forming medium as set forth in claim 9, wherein said protective synthetic resin film sheet is formed as a metallized film sheet.

13. An image-forming medium as set forth in claim 5, wherein said single-pigment ink is composed of a leuco-pigment, and said image-formation layer contains a color developer, with which the discharged single-pigment ink is chemically reacted to develop a given single color in said image-formation layer.

14. An image-forming medium as set forth in claim 1, wherein said single-pigment ink is composed of a leuco-pigment, and said image-formation layer is a solid color developer layer, with which the discharged single-pigment ink is chemically reacted to develop said single-pigment in said image-formation layer.

15. An image-forming medium as set forth in claim 1, wherein an image is formed as a mirror image on said microcapsule layer by the discharged single-pigment ink, and is observable through a transparent film sheet.

16. An image-forming medium comprising:

a base member;

a layer of microcapsules, coated over said base member, containing a type of microcapsule filled with a single-pigment ink, said type of microcapsule exhibiting a temperature/pressure characteristic such that each said microcapsule is configured to be squashed under a predetermined pressure at a predetermined temperature, whereupon said single-pigment ink is discharged from the squashed said microcapsule; and an image-formation layer coated over said microcapsule layer, wherein said image-formation layer is constituted such that a single color corresponding to the discharged single-pigment ink is developed in the image-formation layer.

17. An image-formation medium as set forth in claim 16, wherein:

said type of microcapsule is a first type of microcapsule;

said temperature/pressure characteristic is a first temperature/pressure characteristic;

said predetermined pressure is a first predetermined pressure;

said predetermined temperature is a first predetermined temperature;

said single-pigment ink is a first single-pigment ink; and said microcapsule layer further contains a second type of microcapsule filled with a second single-pigment ink, which exhibits a second temperature/pressure characteristic such that each microcapsule is squashed under a second predetermined pressure at a second predetermined temperature, whereby said second single-pigment ink is discharged from said squashed microcapsule, the discharged second single-pigment ink being developed in the image-formation layer.

18. An image-forming medium as set forth in claim 17, wherein said microcapsule layer further contains a third type of microcapsule filled with a third single-pigment ink, which exhibits a third temperature/pressure characteristic such that each microcapsule is squashed under a third predetermined pressure at a third predetermined temperature, whereby said third single-pigment ink is discharged from said squashed microcapsule, the discharged third single-pigment ink being developed in the image-formation layer.

19. An image-forming medium as set forth in claim 18, wherein said first, second and third single-pigment inks form three primary colors.

20. An image-forming medium as set forth in claim 16, wherein said image-formation layer is formed as a porous layer comprising white powder, and the development of the discharged single-pigment ink in the image-formation layer is carried out by permeation of the discharged single-pigment ink into the porous layer.

21. An image-forming medium as set forth in claim 20, wherein said base member is formed as a sheet of protective synthetic resin film covering said microcapsule layer.

22. An image-forming medium as set forth in claim 21, wherein said white powder is selected from the group consisting of calcium carbonate powder, titanium dioxide powder, silica powder and white clay powder, and said protective synthetic resin film sheet is formed of polyethylene terephthalate.

23. An image-forming medium as set forth in claim 22, wherein said image-formation layer has a thickness of about 0.02 mm to about 0.025 mm.

24. An image-forming medium as set forth in claim 22, wherein said protective synthetic resin film sheet is colored white.

25. An image-forming medium as set forth in claim 22, wherein said protective synthetic resin film sheet is formed as a metallized film sheet.

26. An image-forming medium as set forth in claim 20, wherein said single-pigment ink is composed of a leuco-pigment, and said image-formation layer contains a color developer, with which the discharged single-pigment ink is chemically reacted to develop a given single color in said image-formation layer.

27. An image-forming medium as set forth in claim 16, wherein said first single-pigment ink is composed of a leuco-pigment, and said-formation layer is formed as a solid color developer layer, with which the discharged first single-pigment ink is chemically reacted to develop a given single-pigment in said image-formation layer.

28. An image-forming medium as set forth in claim 16, wherein an image is formed as a mirror image on said microcapsule layer by the discharged first single-pigment ink, and is observed from a side of said image-formation layer opposed to said microcapsule layer.

* * * * *